US006255566B1

(12) United States Patent
Bly

(10) Patent No.: US 6,255,566 B1
(45) Date of Patent: Jul. 3, 2001

(54) UNITARY GUITAR CONSTRUCTION

(76) Inventor: Michael John Bly, 2885 Bynan #103, Ypsilanti, MI (US) 48197

( * ) Notice: Subject to any disclaimer, the term of this patent is extended or adjusted under 35 U.S.C. 154(b) by 0 days.

(21) Appl. No.: 09/306,365

(22) Filed: May 6, 1999

(51) Int. Cl.[7] ..... G10D 3/00
(52) U.S. Cl. ..... 84/291; 84/293; 84/267; 84/290
(58) Field of Search ..... 84/173, 267, 290, 84/293, 291; 446/213, 408, 397, 406

(56) References Cited

U.S. PATENT DOCUMENTS 4,088,050 5/1978 Appel .
4,359,923 11/1982 Brunet .
5,463,923 * 11/1995 Kamijyo ..... 84/291
5,900,561 * 5/1999 Wechter ..... 84/267

* cited by examiner

*Primary Examiner*—Robert E. Nappi
*Assistant Examiner*—Kim Lockett

(57) ABSTRACT

A guitar construction having a complete body, neck, and head, formed as a single, integral wooden carving with tuning pegs, fingerboard, bridge, nut, and strings mounted thereon. The body portion is in the usual bell-shaped outline. Conventional pick-up means for an electronic amplification system may be mounted to the body.

5 Claims, 3 Drawing Sheets

UNITARY GUITAR CONSTRUCTION

BACKGROUND—FIELD OF INVENTION

The present invention relates to stringed musical instrument construction, and more specifically to an improved construction for a guitar, or similar instrument.

BACKGROUND—DESCRIPTION OF PRIOR ART

It is the usual practice to construct various portions of guitars separately and to join such separate portions in assembling the finished instrument. Joints between the neck and body are of the following types:

1. The neck is glued onto the body.
2. The neck is bolted onto the body.
3. The neck is glued and bolted onto the body. Also, the neck may extend the length of the instrument while having portions of the body glued onto the sides of the neck.

Since the tonal quality and other factors concerned with optimum sound output are to some extent dependent upon the structural integrity of the instrument, there is inevitably some loss in quality due to the fact that various portions of the instrument, though permanently assembled, are actually separate pieces. There is also the possibility that, although initially joined in a secure manner, the formed portions may become loose or detached.

Patents have been granted for unitary guitar construction. However, these guitars are formed from plastic and metal. The unitary guitar construction in U.S. Pat. No. 4,359,923 to Brunet, Nov. 23, 1982 is formed of aluminum. The unitary guitar construction in U.S. Pat. No. 4,088,050 to Appel, May 9, 1978 is formed from plastic. Due to its resonance properties, wood is the general and preferred material that guitars or like instruments are made of.

OBJECTS AND ADVANTAGES

Discontinuities in the instrument vibrations are caused by attaching the neck to the body of the instrument by:

1. Gluing.
2. Bolting.
3. Gluing and bolting. as well as the neck through the body design.

The current invention solves the problem of the neck/body joint by making the neck and body as one piece of wood.

It is a principal object of the present invention to provide a novel and improved construction for a guitar, or similar stringed instrument, which has superior sound qualities.

A further object is to provide a guitar, or the like, having both neck and body which are formed integrally, thereby improving the sustain of string vibration.

This invention avoids the neck/body joint, thus allowing a continuity of induced vibrations produced in the instrument. Still further objects and advantages will become apparent from a consideration of the ensuing description and drawing.

DRAWING FIGURES

FIGS. 1, 2, and 3 are front, rear, and side elevational views, respectively, of a unitary carving upon which the guitar construction of the invention is based;

FIGS. 4, 5, and 6 are front, rear and side elevational views, respectively, of a fully assembled guitar incorporating the carving of FIGS. 1–3;

DESCRIPTION—FIGS. 1 to 10

Figure 1:
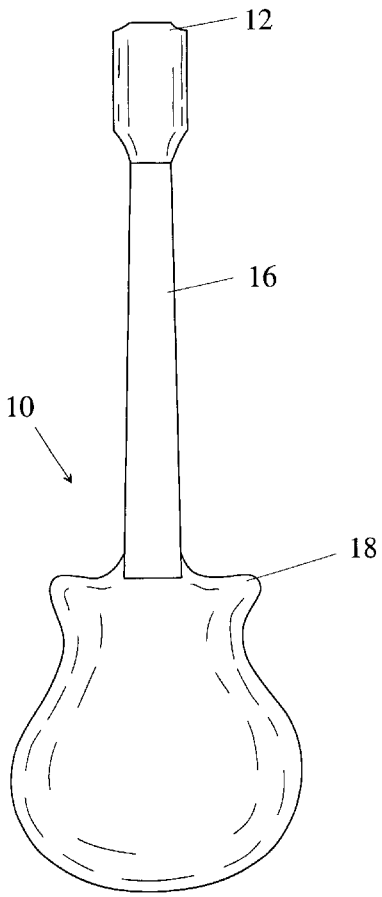
Figure 2:
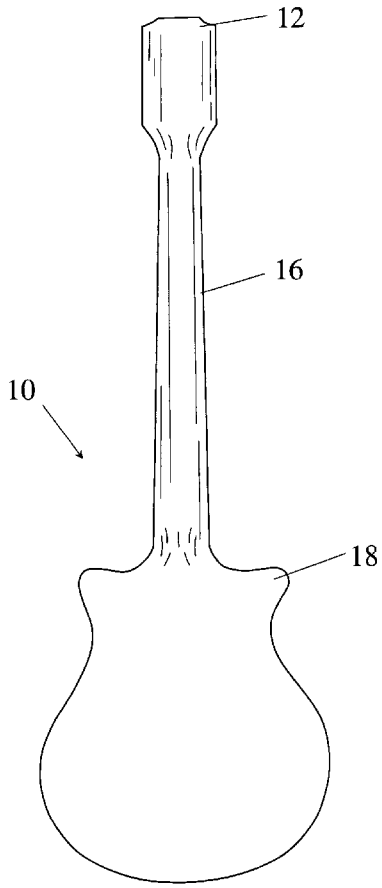
Figure 3:
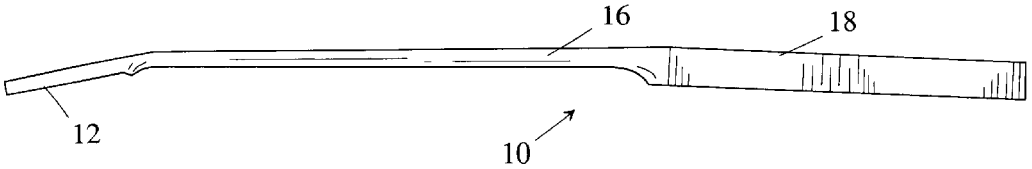

Referring now to the drawings, in FIGS. 1–3 is shown a unitary, integral wooden carving 10, formed by conventional woodworking techniques. Carving 10 includes all of the basic elements of a guitar, or similar instrument, minus the strings, tuning pegs, fingerboard, bridge and any desired electronic pick-up and amplification means. That is, carving 10 is a continuous single piece of wood which includes head 12, neck 16, and a body portion generally denoted by the reference numeral 18. The exterior of body 18 is carved integrally therewith in the usual shape which, for purposes of the present application, shall be referred to as "bell-shaped". Neck 16 is carved wherein a separately fabricated fingerboard and torsion bar may be fixedly attached, as later described.

Figure 4:
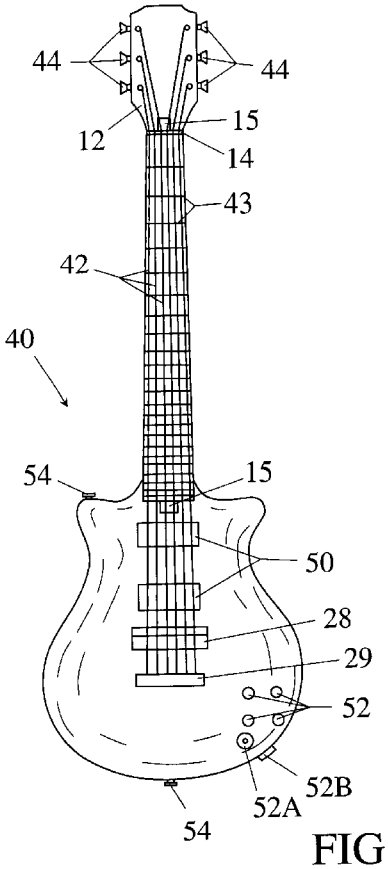
Figure 5:
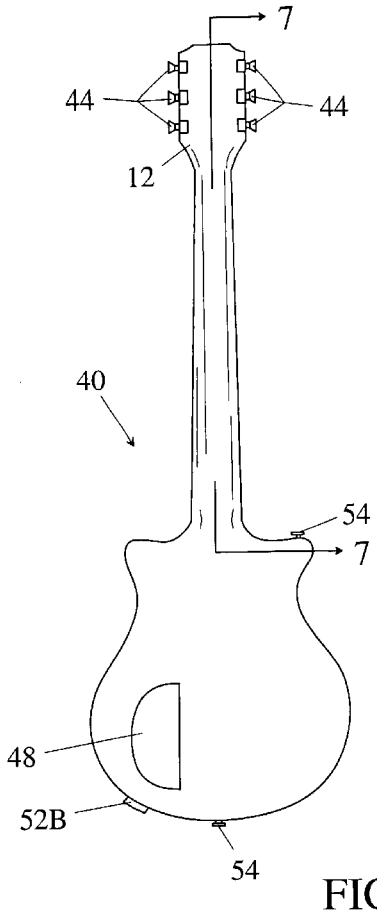
Figure 6:
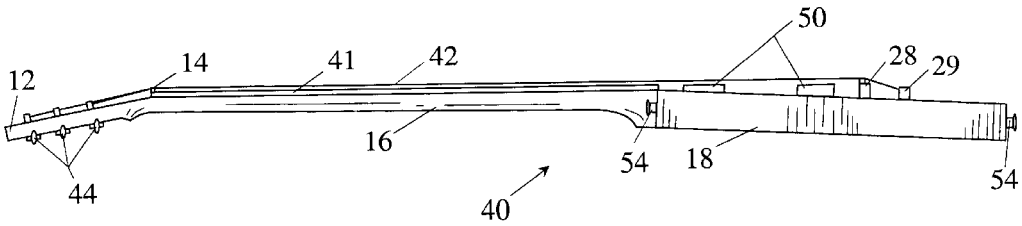

Turning now to FIGS. 4–6, a completely assembled guitar based upon the single-piece carving of FIGS. 1–3 is shown. The completed guitar, denoted generally by reference numeral 40, includes strings 42 anchored at one end to tail piece 29 and at the other to tuning pegs 44, passing over and contacting nut 14 at the juncture of head 12 and neck 16. Strings 42 are thus tensioned between nut 14 and tail piece 29. Metal frets 43 form a portion of the fingerboard which are supported in essentially parallel relation and spaced a desired distance from frets 43 by bridge 28 which is mounted on body 18. Also, various pick-up and wiring combinations may be conveniently interchanged. Electronic pick-ups 50 are controlled by the pick-up switch 52A and controls 52. The electronic signal goes to the jack 52B. The body 18 may be drilled and tapped for mounting of knobs 54 to which a support strap may be attached. The electronics cover 48 is attached to the rear of the body. Covers 15 are placed over the ends of the truss rod.

Figure 7:
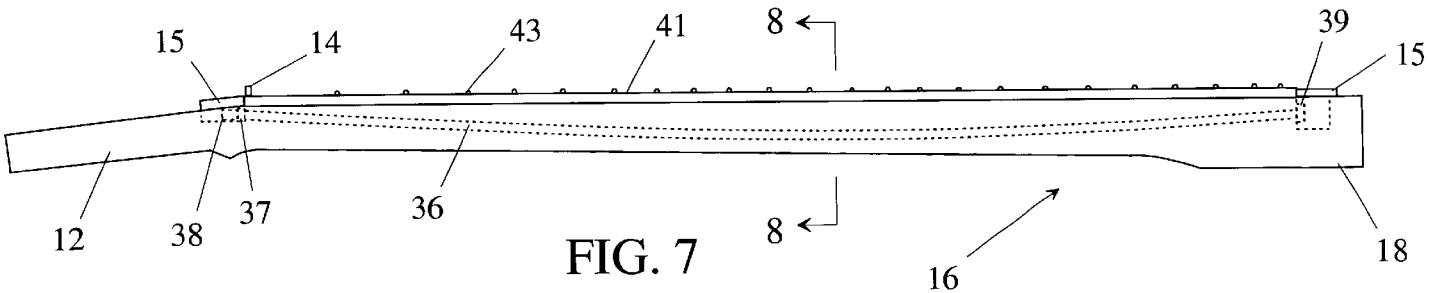
FIG. 7 shows a side view of the guitar neck of fragmentary side view of line 7—7 of FIG. 5 and a torsion bar associated therewith in phantom.
Figure 9:
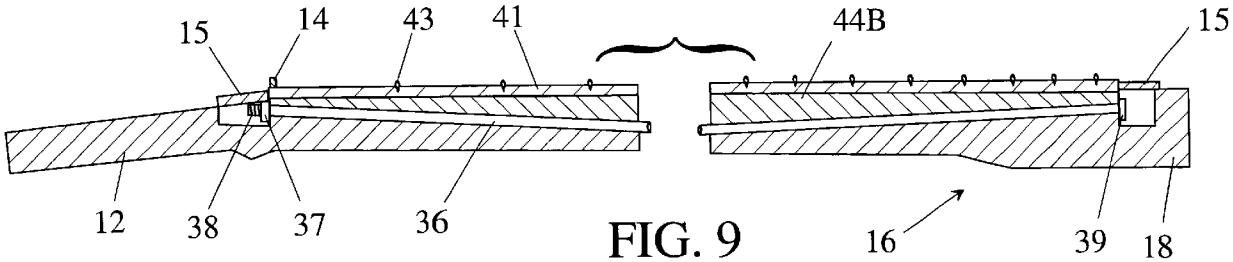
FIG. 9 is a sectional view taken along lines 9—9 of FIG. 8.
Figure 10:
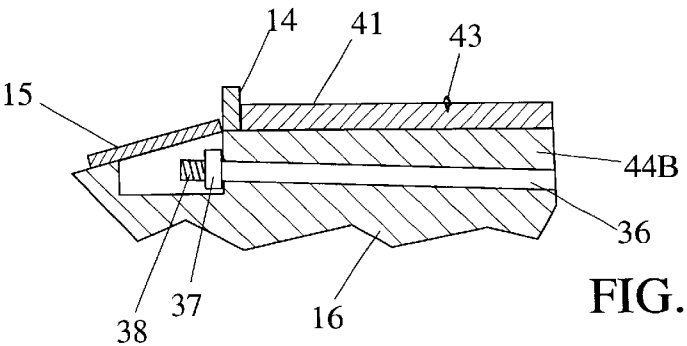
FIG. 10 is a detailed view of one end of the torsion rod where it meets a terminal point of a fingerboard and the guitar neck itself.
Figure 8:
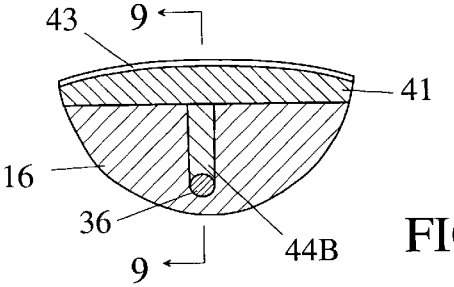
FIG. 8 is a sectional view taken along lines 8—8 of FIG.7.

The guitar neck 16 FIG.7 can generally be regarded as having a central groove on its top face nearest the finger board 41 to allow placement therein of a torsion rod 36. A torsion rod is affixed at opposed extremities by a headed end 39 at one extremity and a threaded terminus 38 at the opposed extremity and with a lock washer and nut 37 disposed on the threaded end. The torsion rod has a complex curvature which bows initially away from the fret and fingerboard 41 and thereafter curves upwardly towards the fingerboard and terminates at the headed end.

Traditional fingerboards are made from rosewood or ebony because of the wear characteristics and the impervious nature of this wood to acid as well as providing resiliency. The groove between the torsion bar and the finger board has traditionally been filled by a wooden insert. In this way, when the strings are disposed upon the finger board and tensioned properly, the tendency of the finger board to bow in response to this tension is cancelled out by the opposing force provided by the torsion rod.

The frets 43 can be pressed in and suitably affixed with adhesive, and the left terminal portion of the finger board is provided with a string spacing device defined as a nut 14. As shown in cross section of FIG. 8 the finger board therefore provided with a downwardly extending rib 44 which fills the slot above the torsion rod 36, and the neck is shown to define a semi-cylindrical solid having a central groove for reception of the web 44 and a cover 15.

The area nearest the torsion head 39 is provided with space to allow adjustment between the finger board and the neck and lateral translation thereabout is possible.

Summary, Ramifications, and Scope

In accordance with the foregoing objects, the invention contemplates a guitar construction wherein all major portions, including head, neck, and body, are formed as a unitary, integral wood carving.

The described construction fulfills the desired objectives through the provision of a unitary carving. Improved tone and clarity are achieved by the design of the one-piece carving. The unit combines a rugged and durable construction.

Thus, the construction of the present invention provides an instrument with improved sound qualities. This improvement is achieved by forming the body, neck and head as a single piece carving.

What is claimed is:

1. A guitar, or similar stringed instrument, comprising:

(a) a unitary, wooden carving forming a body, a neck formed integrally with said body and extending from one side thereof, and a head formed integrally with said neck and extending from the end thereof opposite said body;

(b) said body said neck and said head carved from one piece of wood, said piece of wood having a cellular structure substantially similar to its original state;

(c) the junction of said neck with said body having a cellular structure substantially similar to its original state;

(d) the junction of said head with said neck having a cellular structure substantially similar to its original state;

(e) a plurality of tensioned strings extending between anchored position on said head and a tailpiece on said body;

(f) a bridge supporting said strings, whereby vibrations of said strings are transmitted through said body;

(g) a nut substantially at the junction of said neck and said head; and (h) a fingerboard disposed upon said neck.

2. The device of claim 1 in which said neck is provided with a central channel having varying depths disposed along its longitudinal extent, and a torsion rod is disposed therein, and said fingerboard comprises top portion adapted to overlie the top of said neck, and a medially downwardly disposed web which resides within said channel in juxtaposition with said torsion rod so as to provide a link between said torsion rod and said finger board for adjusting and compensating for stresses imposed by strings on a guitar.

3. The device of claim 2 in which said fingerboard is provided with integral frets parallelly oriented to each other and orthogonally disposed relative to the longitudinal axis of said fingerboard.

4. The device of claim 1 in which said body is substantially solid.

5. The device of claim 1 in which said body is substantially hollow.

* * * * *